US007191524B2

(12) United States Patent
Longstreth

(10) Patent No.: US 7,191,524 B2
(45) Date of Patent: Mar. 20, 2007

(54) CABBAGE CUTTER

(75) Inventor: Billie Jean Longstreth, 406 Rising Hill Dr., Fairborn, OH (US) 45324

(73) Assignee: Billie Jean Longstreth, Fairborn, OH (US)

( * ) Notice: Subject to any disclaimer, the term of this patent is extended or adjusted under 35 U.S.C. 154(b) by 1116 days.

(21) Appl. No.: 09/025,896

(22) Filed: Feb. 18, 1998

(65) Prior Publication Data

US 2002/0032967 A1 Mar. 21, 2002

(51) Int. Cl.
*B26B 3/00* (2006.01)
*B26B 29/00* (2006.01)

(52) U.S. Cl. ..... 30/151; 30/316

(58) Field of Classification Search ..... 30/316, 30/295, 151

See application file for complete search history.

(56) References Cited

U.S. PATENT DOCUMENTS

| | | | | | |
|---|---|---|---|---|---|
| D25,098 | S | * | 1/1896 | Harris | D7/381 |
| 893,425 | A | * | 7/1908 | Bell | 30/316 X |
| 1,100,489 | A | * | 6/1914 | Palmer | 30/316 X |
| 1,297,900 | A | * | 3/1919 | Patton | 30/316 X |
| 1,525,514 | A | * | 2/1925 | Rothje | 30/316 X |
| 1,595,542 | A | * | 8/1926 | Bundy | 30/151 X |
| 2,568,284 | A | * | 9/1951 | Harrison | 83/695 |
| 2,993,273 | A | * | 7/1961 | Engstrom | 30/123.6 |
| 3,004,340 | A | * | 10/1961 | Collins | 30/316 X |
| 3,456,346 | A | * | 7/1969 | Snyder | 30/151 X |
| 4,346,517 | A | * | 8/1982 | Cianflone | 30/49 |
| D290,920 | S | * | 7/1987 | Zaruba et al. | D7/672 |
| 4,836,396 | A | * | 6/1989 | Ancona et al. | 220/212 |
| 4,843,716 | A | * | 7/1989 | Lutzker | 30/316 X |
| 4,858,317 | A | * | 8/1989 | Seib et al. | 30/316 X |
| 5,022,843 | A | * | 6/1991 | Secondiak | 30/316 X |
| 5,103,563 | A | * | 4/1992 | Johnson | 30/316 X |

FOREIGN PATENT DOCUMENTS

| | | | | |
|---|---|---|---|---|
| FR | 592282 | * | 7/1925 | 30/151 |

OTHER PUBLICATIONS

Kitchen Classics (www.kitchen-classics.com), Italian made Cutter Sets, Copyright 1998.*

* cited by examiner

*Primary Examiner*—Kenneth E. Peterson

(57) ABSTRACT

A kitchen utensil designed specifically to cut and chop cabbage comprising a cylindrical hollow body with a closed top and an open bottom connected by a cylindrical wall. The closed top has a permanently affixed handgrip that covers the top and extends slightly over onto the wall of the device. The open bottom of the device is filed or rubbed down to a smooth, thin, sharp, cutting and chopping edge that can be sharpened if the cutting and chopping edge should become dulled from extensive use. The device has a removable protective cover for the cutting and chopping edge that serves as a shield from injury, and protects the cutting and chopping edge from becoming damaged when the cabbage cutter is not in use.

1 Claim, 1 Drawing Sheet

CABBAGE CUTTER

BACKGROUND OF THE INVENTION

This invention is a non-powered, hand operated cabbage cutter designed specifically to cut and chop cabbage.

Cabbage is a popular vegetable often served alone or in combination with other vegetables, or ingredients, in a variety of recipes. Cabbage, because of its short, thick stalk, and large head formed by tightly overlapping leaves, is the most difficult vegetable to cut up. Therefore, the strength and durability of the device used to cut or chop cabbage is very important. Cooks are always looking for that certain device that might make the cutting of cabbage an easier task. Many have wasted their money by purchasing devices they think will work better, only to be disappointed time and again. Cooks today use a variety of knives, powered grinders, blenders, and food processors to cut cabbage. The problem is that the devices sold on the market today are designed to cut, chop, mix, and blend a variety of vegetables and foods, thus, their efficiency is limited when cutting the most difficult vegetable cabbage. Cabbage is so difficult to cut or chop it should be placed in a category by itself. Vegetable cutters and choppers sold on the market today have other disadvantages too. The powered devices jam, and may have to be cleaned out several times during the process of cutting or chopping up one head of cabbage. They are slow, tedious, and most likely require some assembly before each use. They are also expensive and difficult to clean. The non-powered, hand-operated devices that are designed with open top rims and those designed with removable tops and handgrips lack the sturdiness and durability to withstand the friction and force of the heavier chopping and cutting motion that is required for cabbage and, therefore, may bend and become ineffective.

This invention was developed from a homemade device I have used for several years. I cut off the open rim of an empty tin can, thus turning the rim into a sharp cutting and chopping edge that very effectively cuts cabbage to any size desired. I have found that this homemade device works better than any of the commercially sold devices. Although this homemade device works better to cut and chop cabbage than any device sold on the market, it also has disadvantages. Since tin is flimsy and corrosive, it lacks the sturdiness, strength, and durability to withstand repeated use. Therefore, the rim of an empty tin can must be cut off for each head of cabbage cut up.

There is definitely a need for a device that has been designed and developed specifically to cut cabbage—a device that is strong, durable, and inexpensive to manufacture. This device is easy to use, requires no assembly, has no parts that may malfunction during use, and is easy to clean. This device will satisfy all the needs mentioned above.

BRIEF SUMMARY OF THE INVENTION

The object of this invention is to provide a strong, durable, inexpensive, and easy to use device that has been designed and manufactured specifically to cut and chop cabbage. This cabbage cutter is a non-powered, hand operated cutting and chopping device comprising a hollow, metal, cylindrical body having two ends, that when placed in a perpendicular position, has a circular top and a circular bottom connected by the cylindrical body wall. The circular top is closed and covered with a permanently affixed cap that extends slightly over onto the exterior wall of the cylindrical body to serve as a handgrip and provide additional strength and durability to the cabbage cutter. The circular bottom rim is open and filed or rubbed down to a smooth, thin, sharp cutting and chopping means that can be sharpened should it become dulled with use. The cabbage cutter has a removable protective cover, contiguous with the cutting and chopping means, that when placed over the cutting and chopping means serves as a protective shield from injury, and protects the cutting and chopping means from becoming damaged when the device is not in use or stored.

The placement of the permanently affixed cap (handgrip) over the closed, metal, circular top adds substantial strength and durability and distinguishes this cabbage cutter from all other non-powered, hand-operated devices in the art that are designed with open top rims, removable tops, and/or removable handgrips.

This device works best when the cabbage head is cut into chunks, placed in a large container, and the person using the device grasps the cap (handgrip) and brings the circular cutting and chopping means down repeatedly (in an up and down motion) onto the cabbage, cutting the cabbage to desired size. This cabbage cutter was designed and constructed for strength and durability and can easily, efficiently, and effectively cut through the thick stalks and tightly overlapping leaves of the cabbage.

The cabbage cutter is simply designed, is easy to use, requires no assembly, and has no parts to malfunction during use. Removing the protective cover from the cutting and chopping means readies the device for use. The cabbage cutter is inexpensive to manufacture and, therefore, inexpensive to purchase. The cabbage cutter is easy to clean, dishwasher safe, and takes only a small space to store when not in use.

DETAILED DESCRIPTION OF THE INVENTION

Figure 4:
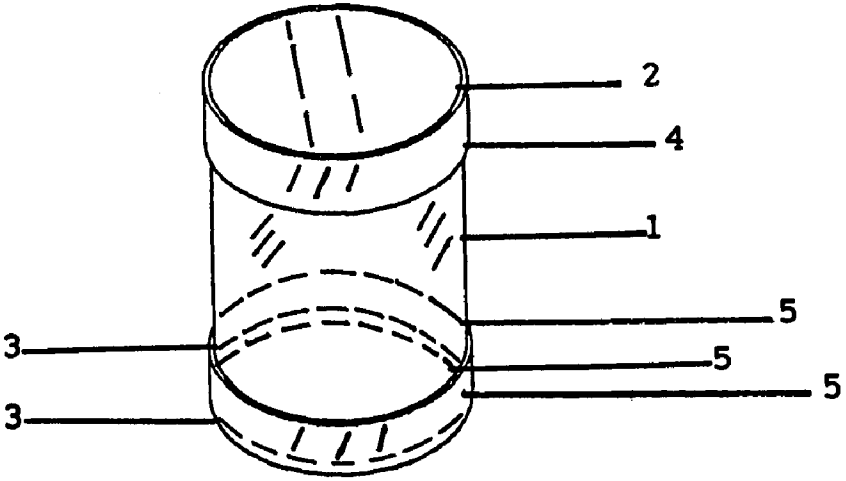
FIG. 4 is a view of the embodiment of the cabbage cutter when the device is not in use comprised of the hollow, metal, cylindrical body 1 having a closed circular top 2, an open circular bottom rim with a cutting and chopping means 3, a permanently affixed cap (handgrip) 4 that covers the closed circular top 2 and extends slightly over onto the exterior wall of the cylindrical body 1, and a protective cover 5, contiguous with the cutting and chopping means 3, are shown in place.
Figure 2:
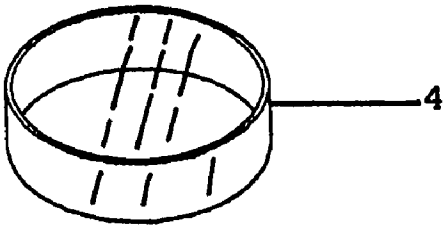
FIG. 2 is a view of the cap (handgrip) 4 that is permanently affixed to the closed circular top 2 and extends slightly over onto the exterior wall of the cylindrical body 1.
Figure 3:
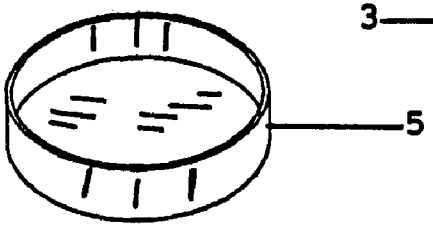
FIG. 3 is a view of the protective cover 5, contiguous with the cutting and chopping means 3, that, when placed over the cutting and chopping means 3 serves as a protective shield from injury, and protects the cutting and chopping means 3 from becoming damaged when the cabbage cutter is not in use.
Figure 1:
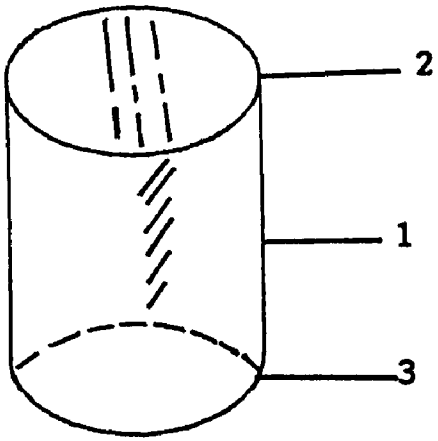
FIG. 1 is a view of the hollow, metal, cylindrical body 1 having a closed-circular top 2 and an open circular bottom rim with a cutting and chopping means 3 connected by the cylindrical body wall 1.

This cabbage cutter is a non-powered, hand-operated device designed specifically to cut and chop cabbage comprising a hollow, metal, cylindrical body 1 having two ends and when placed in a perpendicular position has a circular top 2 and a circular bottom 3 connected by the cylindrical body wall 1. The circular top 2 is closed and the circular bottom rim 3 is open. The closed circular top 2 is covered with a permanently affixed cap (handgrip) 4 that extends slightly over onto the exterior wall of the cylindrical body 1 to serve as a handgrip so that the person using the cabbage cutter will be able to maintain a good grip on the device to use the device efficiently and effectively at all times, and to provide additional strength and durability to the device. The open circular bottom rim 3 of the cylindrical body 1 is filed or rubbed down to a smooth, thin, sharp cutting and chopping means 3 that can be sharpened if it should become dulled from extensive use. The cabbage cutter has a removable protective cover 5, contiguous with the cutting and chopping means 3, that, when placed over the cutting and chopping means 3 serves as a protective shield from injury, and protects the cutting and chopping means 3 from becoming damaged when the cabbage cutter is not in use.

The placement of the permanently affixed cap (handgrip) 4 over the closed metal circular top 2 provides additional strength and durability to the cabbage cutter that is lacking in the prior art devices, and distinguishes this cabbage cutter from all other prior art devices. All the other non-powered, hand-operated cutting and chopping devices in the art are designed with open top rims, removable tops and/or removable handgrips which weaken the strength and durability of the devices. The strength and durability of the device is an important factor to consider when choosing a device to cut cabbage.

This cabbage cutter works best when the cabbage head is cut in chunks and placed in a large container. The person using the device grasps the cap (handgrip) 4 and brings the circular cutting and chopping means 3 down repeatedly (in an up and down motion) onto the cabbage, cutting the cabbage to the desired size.

Although this cabbage cutter is simply designed, the device was designed and constructed for strength and durability. The device is easy to operate, inexpensive to manufacture, inexpensive to purchase, easy to clean, dishwasher safe, requires no assembly, and has no complicated movable parts that may malfunction during use.

While there has been shown and described a preferred embodiment of the cabbage cutter, it is understood that changes in structure, material, sizes and shapes can be made without departing from the invention. The invention is defined in the following claim.

I claim:

1. I claim a vegetable cutter that is non-powered and hand-operated for cutting and chopping vegetables comprising;

a hollow, metal, cylindrical body having two ends and when placed in a vertical position has a top and a bottom that are connected by a cylindrical wall, the top is sealed closed by a first flat disk and the bottom is sharpened to a smooth, thin, annular cutting edge, a handgrip permanently affixed to and covering the top of the cylindrical body, the handgrip consisting of a second flat disk having a depending circumferential portion that extends slightly over onto the wall of the cylindrical body and provides additional strength to the cylindrical body, a removable protective cover, that when placed over the cutting edge serves as a shield from injury, and protects the cutting edge from becoming damaged when the device is not in use, the cover consisting of a third flat disk having an upending circumferential portion that extends slightly over onto the wall of the cylindrical body to releasable retain the cover on the cylindrical body.

* * * * *